US005409053A

United States Patent [19]

Kawa et al.

[11] Patent Number: 5,409,053

[45] Date of Patent: Apr. 25, 1995

[54] CONTINUOUS CASTING MOLD

[75] Inventors: Franciszek Kawa, Adliswil; Adrian Stilli, Bulach, both of Switzerland

[73] Assignee: Concast Standard AG, Zurich, Switzerland

[21] Appl. No.: 75,162

[22] Filed: Jun. 10, 1993

Related U.S. Application Data

[63] Continuation-in-part of Ser. No. 831,681, Feb. 5, 1992, Pat. No. 5,360,053.

[30] Foreign Application Priority Data

Jun. 11, 1992 [CH] Switzerland ..... 01 848/92

[51] Int. Cl.[6] ..... B22D 11/04

[52] U.S. Cl. ..... 164/418; 164/459

[58] Field of Search ..... 164/418, 459, 435

[56] References Cited

U.S. PATENT DOCUMENTS 4,774,995 10/1988 Fastert ..... 164/418
4,811,779 3/1989 Streubel et al. ..... 164/418

FOREIGN PATENT DOCUMENTS 50-27027 9/1975 Japan ..... 164/418
53-11124 2/1978 Japan ..... 164/418
58-151943 9/1983 Japan ..... 164/418
64-75146 3/1989 Japan ..... 164/418
1-33265 7/1989 Japan ..... 164/418
143215 5/1961 U.S.S.R. ..... 164/418

*Primary Examiner*—J. Reed Batten, Jr.
*Attorney, Agent, or Firm*—Darby & Darby

[57] ABSTRACT

The mold includes a mold tube having pairs of parallel opposed outer surface portions which extend axially of the mold tube. The mold tube defines an axial casting passage having an inlet end for molten metal and an outlet end for a continuously cast strand of the metal. The mold tube is provided with internal concavities which are uniformly distributed peripherally of the casting passage. The internal concavities, which extend in a direction from the inlet end towards the outlet end, become smaller in this direction and are designed so that the strand is shaped as it travels along the casting passage. To form the mold tube, external concavities are impressed or cut in a tubular blank and a mandrel with external protuberances is then pressed into the blank. If necessary, the tubular blank can thereafter be drawn or otherwise processed to produce the desired outer contour of the mold tube.

8 Claims, 1 Drawing Sheet

CONTINUOUS CASTING MOLD

CROSS-REFERENCE TO RELATED APPLICATION

This application is a continuation-in-part of application Ser. No. 07/831,681, filed Feb. 5, 1992, and now U.S. Pat. No. 5,360,053.

BACKGROUND OF THE INVENTION

The invention relates generally to a continuous casting mold.

More particularly, the invention relates to a mold for the continuous casting of metal, especially for the continuous casting of steel into billets and blooms.

The as-yet unpublished Swiss patent application 03263/91 discloses a mold having a casting passage which, in a manner similar to a drawing operation, causes deformation of a continuously cast strand as the strand travels through the mold. A plurality of concavities are formed at the inlet end of the mold along the internal periphery of the same, and the mold has corresponding external protuberances. The depths of the concavities decrease in a direction towards the outlet end of the mold. The deformation of a strand is greater at the center of a concavity than at the two lateral edges thereof where, as a rule, there is little or no deformation. At locations of a concavity center which are remote from the inlet end of the mold so that the depth is greatly reduced, the strand lies snugly against the mold wall resulting in intensive cooling of the strand and a high wall temperature. In contrast, the wall temperature at the edges of the concavity is relatively low. Such a nonuniform wall temperature is not always desirable.

For tubular molds with external protuberances, the cooling jackets must also be provided with protuberances in order to produce gaps of uniform size between mold and cooling jacket. This represents a drawback since cooling jackets of this type are complex and expensive to manufacture.

SUMMARY OF THE INVENTION

It is an object of the invention to provide a continuous casting mold which enables a more uniform wall temperature to be achieved.

Another object of the invention is to provide a continuous casting mold which makes it possible to reduce mold wear.

An additional object of the invention is to provide a continuous casting mold which can have a relatively simple design.

A further object of the invention is to provide a continuous casting mold which, while capable of deforming a continuously cast strand, can be relatively simple and allows a relatively uniform wall temperature, as well as reduced wear, to be achieved.

It is also an object of the invention to provide a mold production method which permits wall temperatures of greater uniformity to be obtained.

Still another object of the invention is to provide a mold production method which enables wear to be reduced.

A concomitant object of the invention is to provide a mold production method able to yield a continuous casting mold which, although capable of subjecting a strand to deformation, allows a relatively uniform wall temperature and reduced wear to be achieved.

The preceding objects, as well as others which will become apparent as the description proceeds, are achieved by the invention.

One aspect of the invention resides in a mold for the continuous casting of metal, particularly for the continuous casting of steel into billets and blooms. The mold comprises a tubular member or mold tube of high thermal conductivity having a longitudinal axis, axially spaced first and second ends, and pairs of opposed outer surface portions extending in axial direction of the mold tube. The mold tube defines an axial casting passage which is open at the first and second ends, and the mold tube is provided with internal concavities which are substantially uniformly distributed peripherally of the casting passage. The concavities extend in axial direction of the mold tube from the first end towards the second end and decrease in size in this direction such that a continuously cast strand formed in the casting passage and travelling in the stated direction undergoes deformation. The opposed outer surface portions of each pair of such portions are substantially parallel to one another.

The mold tube is preferably composed of copper or a copper alloy.

In the mold of the invention, it is possible to use a tubular cooling jacket with substantially parallel wall portions. The cooling jacket may, for example, have a square or cylindrical cross section. In the case of a square cross section, the side walls of the cooling jacket can be either straight or convex. Furthermore, by appropriate selection of concavity depth and appropriate selection of mold wall thickness in the central and marginal regions of the mold walls, heat flow through the mold walls, as well as mold wall temperature, may be controlled and made relatively uniform. It is also possible to reduce mold wear by increasing the cooling intensity at the center of a concavity. Moreover, the mold of the invention can have a relatively simple design and can be produced relatively easily. Mold tubes with concavities of different size can be installed in the same cooling jacket or housing.

The concavities may have different depths, e.g., when the mold tube has a rectangular cross section. According to one embodiment of the invention, the mold tube has four sides or wall portions and the cross section of the mold tube is rectangular or square. Here, each side of the mold tube is advantageously provided with a concavity and the ratio of concavity depth to concavity width is at least substantially the same for all concavities. In the case of a square cross section, such ratio is preferably exactly the same for all concavities. The internal corners of the mold tube may be rounded or may be formed with grooves, chamfers, etc.

A tubular cooling jacket can be provided for the mold tube and is designed to surround and define a cooling gap therewith. The cooling jacket has a longitudinal axis and pairs of opposed inner surface portions extending in axial direction of the jacket, and it is preferred for the inner surface portions of each pair to be substantially parallel to one another. This allows the cooling jacket to be manufactured relatively inexpensively.

In accordance with another embodiment of the invention, the wall thickness of the mold tube in the region of the meniscus is selected so that the resistance of a wall to heat flow is 10 to 50 percent lower at the center of a concavity than at the edges thereof. This makes it possible to reduce the mold wall temperature in the casting passage as well as mold wear in the region of maximum friction. For a mold tube with corners, the edges of the concavities may correspond to the corners.

Another aspect of the invention resides in a method of making a mold for the continuous casting of metal, particularly for the continuous casting of steel into billets and blooms. The method comprises the step of forming internal concavities in a tubular component of high thermal conductivity by plastically deforming the interior of the tubular component. The tubular component has a longitudinal axis and an external surface which includes pairs of opposed outer surface portions extending in axial direction of the tubular component, and the method further comprises the step of treating the external surface so that the opposed outer surface portions of each pair are substantially parallel to one another.

The tubular component preferably comprises extruded copper or an extruded copper alloy.

The treating step can, for example, be carried out in such a manner as to impart a substantially cylindrical configuration to the external surface of the tubular component.

One embodiment of the method comprises the additional step of impressing external concavities in the tubular component by plastically deforming the exterior of the tubular component. The impressing step is performed prior to the forming step, and the treating step is carried out without cutting the tubular component. This embodiment of the method can be effected by inserting a first mandrel which is complementary to the interior of the tubular component into the latter. A shaping tool is then used to impress the external concavities in the external surface of the tubular component. The external concavities are formed in that section of the tubular component which is to be subsequently provided with the internal concavities. The first mandrel is withdrawn from the tubular component and a second mandrel is thereupon pushed into the same. The second mandrel has outer protuberances whose shapes are complementary to those of the desired internal concavities. The tubular component is now shaped to produce pairs of parallel outer surface portions at the external surface of the tubular component. The shaping operation preferably involves drawing the tubular component through a drawing die. Due to the precompression of the tubular component by the shaping tool prior to insertion of the second mandrel, the tubular component may be converted into a mold tube without cutting into the tubular component, e.g., by drawing the tubular component.

Instead of drawing the tubular component in order to shape the latter, the tubular component may be explosively formed onto the second mandrel. Here, explosive is applied to the exterior of the tubular component and is detonated while the second mandrel is received in the tubular component. If necessary, a finishing process may be used to make the opposed outer surface portions of the tubular component parallel.

Another embodiment of the method comprises the step of cutting external concavities into the tubular component prior to the forming step. The external concavities are again produced in that section of the tubular component which is to be provided with the internal concavities. The forming step is then carried out in such a manner as to eliminate the external concavities and effect the treating step concurrently with the forming step. The forming step in this embodiment of the method can be performed using a mandrel similar to the previously mentioned second mandrel, that is, using a mandrel with outer protuberances. The mandrel is inserted into the tubular component so that the outer protuberances cause the external concavities to be filled and also cause opposed outer surface portions of the tubular component to become substantially parallel.

The casting passage and/or parallel outer surface portions of a mold tube according to the invention can be produced by means of a cutting or machining operation. However, the method of the invention, and especially the embodiment which employs first and second mandrels and does not involve any cutting, permits the mold tube to be manufactured particularly economically.

The novel features which are considered as characteristic of the invention are set forth in particular in the appended claims. The improved mold production method, as well as the construction and mode of operation of the improved mold, together with additional features and advantages of the method and mold, will, however, be best understood upon perusal of the following detailed description of certain presently preferred embodiments when read in conjunction with the accompanying drawings.

DESCRIPTION OF THE PREFERRED EMBODIMENTS

Figure 1:
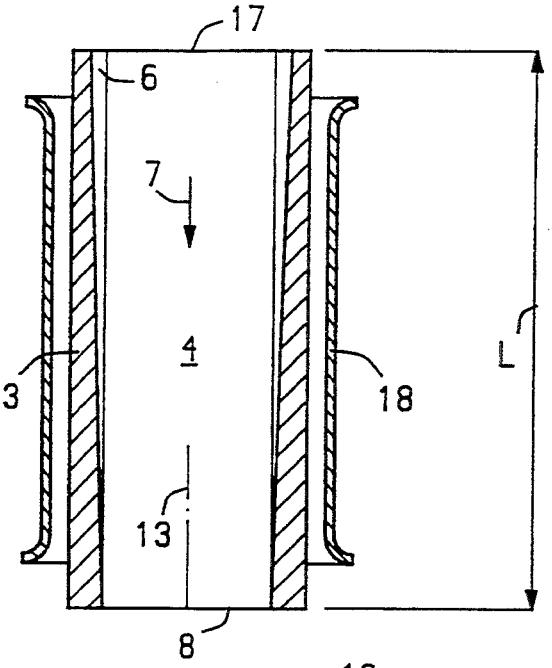
FIG. 1 is a longitudinal sectional view through a mold tube and cooling jacket of a mold according to the invention.

FIG. 1 illustrates a continuous casting mold which includes a mold tube or tubular member 3 and a tubular cooling jacket 18. The mold 3,18 is designed for the continuous casting of metal and is particularly well-suited for the continuous casting of steel into billets or blooms. The mold tube 3 has a length L and a longitudinal axis 13 which also constitutes the longitudinal axis of the cooling jacket 18.

The mold tube 3 has an inlet end 17 for molten metal and an outlet end 8 for a continuously cast strand of the metal. An axial casting passage 4 is defined by the mold tube 3, and the casting passage 4 is open at both the inlet end 17 and the outlet end 8 of the mold tube 3. A continuously cast strand formed in the casting passage 4 travels through the latter in a direction from the inlet end 17 to the outlet end 8 of the mold tube 3 as indicated by the arrow 7. This direction may be referred to as the casting direction.

The mold tube 3 has high thermal conductivity. It is preferred for the mold tube 3 to be composed of copper or a copper alloy.

Figure 2:
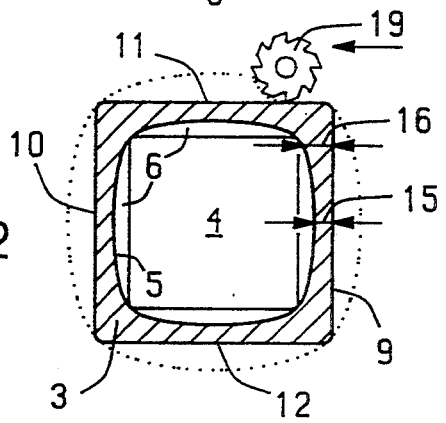
FIG. 2 is a transverse sectional view of the mold tube of FIG. 1.

Referring to FIG. 2 in conjunction with FIG. 1, it can be seen that the mold tube 3 is provided with internal concavities 6. The internal concavities 6 are uniformly distributed peripherally of the internal surface 5 of the mold tube 3. In the illustrated embodiment, the mold tube 3 has four sides or wall portions and each side is formed with one of the concavities 6 so that each concavity 6 extends between two corners of the mold tube 3. The concavities 6 all have the same size and the ratio of concavity depth to concavity width is the same or substantially the same for all of the concavities 6.

The concavities 6 extend axially of the mold tube 3 from the inlet end 17 towards the outlet end 8 thereof, i.e., the concavities 6 extend from the inlet end 17 in the casting direction 7. The concavities 6 terminate at the outlet end 8, and the casting passage 4 has a square cross section at the outlet end 8. Accordingly, a continuously cast strand withdrawn from the casting passage 4 will have a square cross section. The casting passage 4 could also have a rectangular cross section, for example.

The size or depth of each concavity 6 decreases continuously in the casting direction 7 along a distance substantially equal to the length L of the mold tube 3. The concavities 6 are designed in such a manner that a continuously cast strand travelling through the casting passage 4 undergoes deformation.

Each side of the mold tube 3 has an outer surface portion 9, 10, 11 or 12 which extends in the casting direction 7. The outer surface portions 9 and 10 are disposed opposite one another, and the outer surface portions 11 and 12 are likewise disposed opposite one another. The opposed outer surface portions 9,10 are parallel to each other and to the longitudinal axis 13 of the mold tube 3 and, similarly, the opposed outer surface portions 11,12 are parallel to each other and to the longitudinal axis 13. By way of example, the parallel outer surface portions 9, 10 and parallel outer surface portions 11,12 can be produced by a cutting or machining operation using a cutter 19 which is shown in FIG. 2 and moves in the direction of the adjoining arrow.

In contrast to the mold tube 3, a mold tube for continuously casting strands of circular cross section generally has a cylindrical or substantially cylindrical external surface. Such a cylindrical or substantially cylindrical external surface has pairs of parallel opposed outer surface portions which can, for instance, be constituted by the generatrices of the external surface or mold tube.

In FIG. 2, the reference numeral 15 denotes the wall thickness of the mold tube 3 at the center of a concavity 6 where the concavity 6 has its maximum depth and the shape of the mold tube 3 varies the most. On the other hand, the reference numeral 16 denotes the wall thickness of the mold tube 3 at the margin or edge of a concavity 6 where the depth of the concavity 6 is a minimum or nil and the shape of the mold tube 3 varies little, if at all. Heat transfer from the strand to the mold tube 3 is greater in regions of great concavity depth and extreme variation in shape than in the marginal regions of small or zero concavity depth and minimal or no variation in shape. Due to the parallel outer surface portions 9,10 and 11,12, it becomes possible, by appropriate dimensioning of the concavities 6, to select the difference between the wall thicknesses 15 and 16 and thus cause the heat flow through the mold tube 3 to vary peripherally of the latter. In particular, the large heat transfer and high mold wall temperature in the regions of extreme variation in shape may be controlled by suitable reductions in wall thickness.

The tubular cooling jacket 18 which is shown in FIG. 1 functions to direct the cooling water which flows to the mold tube 3. The cooling jacket 18 surrounds the mold tube 3 with clearance and cooperates with the mold tube 3 to define a gap for the cooling water. The cooling jacket 18 can have pairs of opposed parallel walls corresponding to the parallel outer surface portions 9,10 and 11,12 of the mold tube 3 thereby allowing the cooling jacket 18 to be manufactured easily.

In the case of a bent mold tube of circular cross section, the external surface of the mold tube may include pairs of opposed outer surface portions in the form of parallel lines which extend in the casting direction. A cooling jacket for such a mold tube preferably has corresponding pairs of parallel opposed inner surface lines or portions.

Figure 3:
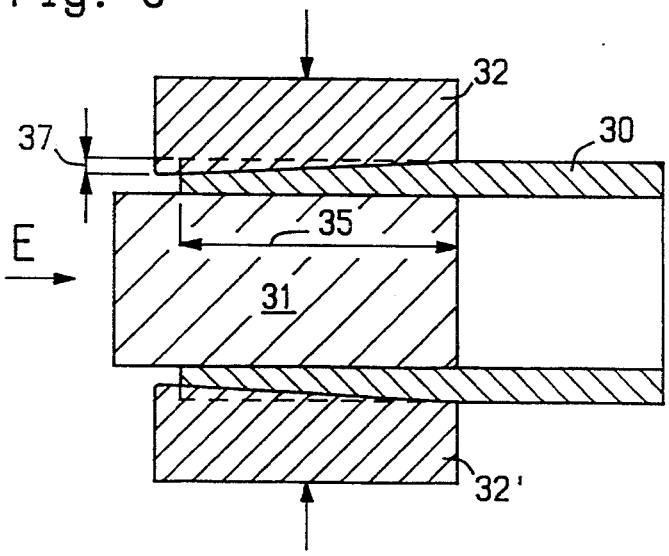
FIG. 3 is a longitudinal sectional view illustrating one operation in the conversion of a tubular blank into a mold tube.
Figure 4:
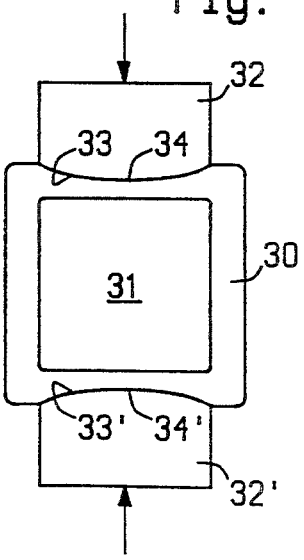
FIG. 4 is a view in the direction of the arrow E of FIG. 3.

FIGS. 3 and 4 illustrate a method in accordance with the invention for producing a mold tube according to the invention.

In FIGS. 3 and 4, the reference numeral 30 identifies a tubular blank or component of high thermal conductivity. The tubular blank 30, which may be an extrusion, is preferably composed of copper or a copper alloy.

A first mandrel 31 complementary to the interior of the tubular blank 30 is inserted in the tubular blank 30 through one end of the latter. Following insertion of the first mandrel 31, external concavities 34,34' are impressed in the outer surface of the tubular blank 30 by means of shaping tools 32 and 32' having convex shaping surfaces 33 and 33', respectively. Any suitable shaping implements can be used for the shaping tools 32,32' including punches, shaping rolls, and so on. Impression of the external concavities 34,34' in the outer surface of the tubular blank 30 is accompanied by a reduction in the wall thickness of the tubular blank 30. The external concavities 34,34' are formed in a section 35 of the tubular blank 30 and the depth 37 of the external concavities 34,34' may vary along the section 35. It is possible for the depth 37 to be zero at the end of the section 35 remote from that end of the tubular blank 30 which receives the first mandrel 31. The depth 37 of the external concavities 34,34' is advantageously substantially equal to, i.e., plus or minus 1 mm, the depth of the internal concavities 6.

Once external concavities have been formed in all four sides of the tubular blank 30, the first mandrel 31 is pressed out of the tubular blank 30. A second mandrel which is provided with outward protuberances and, in known manner, has dimensions corresponding to the specified dimensions of the casting passage 4 is thereupon pressed into the interior of the tubular blank 30. If desired, the tubular blank 30 may additionally be drawn through a drawing die in order to shape the exterior thereor or may be explosively formed onto the second mandrel.

The drawings illustrate a mold tube 3 with a straight casting passage 4. If the method of FIGS. 3 and 4 is to be used to produce a mold tube for a curved-mold continuous casting installation, the tubular blank 30 may be bent to the casting radius of the installation prior to impressing external concavities in the tubular blank 30. The external surface of a bent mold tube may include pairs of opposed outer surface portions in the form of parallel lines which extend in the casting direction.

Instead of impressing external concavities into the tubular blank 30, the external concavities can be formed by a cutting operation. For example, using a cylindrical cutting head, it would be possible to mill external concavities which substantially match the internal concavities 6 and impart the desired outer contour to the tubular blank 30. This can be accomplished by adjusting the angle of inclination and continuously varying the depths of the external concavities.

It is also possible to insert the tubular blank 30 with the external concavities in a female die and, using an appropriate technique such as explosive forming, to simultaneously produce both the internal concavities 6 and the desired outer contour of the mold tube 3 by applying a force to the tubular blank 30 from inside out.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Mold for the continuous casting of metal, comprising a tubular member of high thermal conductivity, said member having a longitudinal axis, axially spaced first and second ends, and pairs of opposed outer surface portions extending in axial direction of said member, said member defining an axial casting passage which is open at said ends, and said member being provided with internal concavities which are substantially uniformly distributed peripherally of said passage, said concavities extending in said direction from said first end towards said second end and decreasing in size in said direction such that a continuously cast strand formed in said passage and travelling in said direction undergoes deformation, the opposed outer surface portions of each pair being substantially parallel to one another; and a tubular jacket surrounding and defining a cooling gap with said member, said jacket having a longitudinal axis and pairs of opposed inner surface portions extending in axial direction of said jacket, the opposed inner surface portions of each pair being substantially parallel to one another.

2. The mold of claim 1, wherein said member comprises copper.

3. The mold of claim 1, wherein said member has four sides and the cross section of said member is substantially rectangular or square, each of said sides being provided with one of said concavities, and the ratio of concavity depth to concavity width being at least approximately the same for all of said concavities.

4. The mold of claim 1, wherein said member has internal corners and said corners are rounded or chamfered.

5. The mold of claim 1, wherein said jacket has a substantially cylindrical interior.

6. The mold of claim 1, wherein each of said concavities has a central section and a marginal section on either side of the respective central section, said member having a first resistance to heat flow at each of said central sections and a second resistance to heat flow at each of said marginal sections, and the first resistance at a central section being about 10 to about 50 percent lower than the second resistance at a respective marginal section.

7. The mold of claim 1, wherein said casting passage is plastically deformed to define said internal concavities, said opposed outer surface portions having a cut surface.

8. The mold of claim 1, wherein said member is plastically deformed to define said outer surface portions and said internal concavities.

* * * * *